US010670024B2

(12) United States Patent
Cheng et al.

(10) Patent No.: US 10,670,024 B2
(45) Date of Patent: Jun. 2, 2020

(54) DIRECT NUMERIC AFFINITY PUMPS SENSORLESS CONVERTER

(71) Applicant: Fluid Handling LLC., Morton Grove, IL (US)

(72) Inventors: Andrew A. Cheng, Wilmette, IL (US); James J. Gu, Buffalo Grove, IL (US); Kyle D. Schoenheit, Waterloo, NY (US)

(73) Assignee: Fluid Handling LLC, Morton Grove, IL (US)

( * ) Notice: Subject to any disclaimer, the term of this patent is extended or adjusted under 35 U.S.C. 154(b) by 278 days.

(21) Appl. No.: 15/173,781

(22) Filed: Jun. 6, 2016

(65) Prior Publication Data

US 2016/0356276 A1 Dec. 8, 2016

Related U.S. Application Data

(60) Provisional application No. 62/170,997, filed on Jun. 4, 2015.

(51) Int. Cl.

| | |
|---|---|
| ***F04D 15/00*** | (2006.01) |
| ***F04B 49/06*** | (2006.01) |
| ***F04B 1/34*** | (2006.01) |

(52) U.S. Cl.

CPC ..... *F04D 15/0088* (2013.01); *F04B 1/34* (2013.01); *F04B 49/065* (2013.01); (Continued)

(58) Field of Classification Search

CPC .. F04B 1/34; F04B 19/00; F04B 19/04; F04B 19/20; F04B 2201/12; F04B 2201/1201; (Continued)

(56) References Cited

U.S. PATENT DOCUMENTS 3,891,817 A * 6/1975 Brown ..... F24D 3/02 219/688
4,108,574 A * 8/1978 Bartley ..... G01F 1/00 417/19

(Continued)

FOREIGN PATENT DOCUMENTS

EP 2610693 B1 12/2014
WO 2008124696 A1 10/2008

(Continued)

OTHER PUBLICATIONS

Making Sense of Sensorless, Empowering pump TM, empoweringpumps.com, May 19, 2014 http://empoweringpumps.com/making-sense-sensorless/.

(Continued)

*Primary Examiner* — Bryan M Lettman
*Assistant Examiner* — Timothy P Solak
(74) *Attorney, Agent, or Firm* — Ware, Fressola, Maguire & Barber LLP

(57) ABSTRACT

A pumping system having a pump includes a pump controller having a signal processor or processing module configured at least to: receive signaling containing information about pump differential pressure, flow rate and corresponding power data at motor maximum speed published by pump manufacturers, as well as instant motor power and speed; and determine corresponding signaling containing information about instant pump differential pressure and flow rate using a combined affinity equation and numerical interpolation algorithm to control the pump in the pumping system, based upon the signaling received.

16 Claims, 6 Drawing Sheets

Pump, system and power characteristics curves with the pressure equilibrium point at a flow steady state.

(52) U.S. Cl.
CPC ..... *F04D 15/0077* (2013.01); *F04B 2205/07* (2013.01); *F04B 2205/09* (2013.01); *F05D 2270/335* (2013.01)

(58) Field of Classification Search
CPC ..... F04B 2201/1203; F04B 2203/0208; F04B 2203/0209; F04B 2205/07; F04B 2205/09; F04D 15/0088; F04D 15/0077; F05D 2270/335
See application file for complete search history.

(56) References Cited

U.S. PATENT DOCUMENTS

| | | | | |
|---|---|---|---|---|
| 6,354,805 | B1 * | 3/2002 | Moller | F04B 49/065 318/473 |
| 7,558,699 | B2 | 7/2009 | Beck et al. | |
| 7,645,225 | B2 | 1/2010 | Medvedev et al. | |
| 7,945,411 | B2 | 5/2011 | Kernan et al. | |
| 8,303,260 | B2 | 11/2012 | Stavale et al. | |
| 8,700,221 | B2 | 4/2014 | Cheng et al. | |
| 8,801,389 | B2 | 8/2014 | Stiles et al. | |
| 8,840,376 | B2 | 9/2014 | Stiles et al. | |
| 8,961,390 | B2 | 2/2015 | Larose et al. | |
| 9,027,398 | B2 | 5/2015 | Ahonen et al. | |
| 2003/0091443 | A1 * | 5/2003 | Sabini | F04D 15/0066 417/53 |
| 2007/0212210 | A1 * | 9/2007 | Kernan | F04D 27/001 415/1 |
| 2008/0067116 | A1 * | 3/2008 | Anderson | E21B 47/042 210/100 |
| 2011/0200454 | A1 * | 8/2011 | Ahonen | F04D 15/0088 417/45 |
| 2012/0251292 | A1 | 10/2012 | Tamminen et al. | |
| 2012/0251340 | A1 * | 10/2012 | Ahonen | F04D 15/0088 417/53 |
| 2013/0164146 | A1 | 6/2013 | Ahola et al. | |
| 2013/0204546 | A1 * | 8/2013 | Devine | F04B 51/00 702/45 |
| 2014/0005841 | A1 | 1/2014 | Cheng et al. | |
| 2014/0135999 | A1 | 5/2014 | Stavale | |
| 2014/0169984 | A1 | 6/2014 | Coin | |
| 2014/0249682 | A1 | 9/2014 | Cheng et al. | |
| 2014/0288716 | A1 | 9/2014 | Cheng et al. | |
| 2015/0032271 | A1 | 1/2015 | Cheng et al. | |
| 2015/0086382 | A1 | 3/2015 | Tamminen et al. | |
| 2016/0010639 | A1 | 1/2016 | Cheng et al. | |

FOREIGN PATENT DOCUMENTS

| | | | |
|---|---|---|---|
| WO | 2014089693 | A1 | 6/2014 |
| WO | 2014149388 | A1 | 9/2014 |

OTHER PUBLICATIONS

"Sensorless pump operation estimation." Power Electronics and Applications, 2009. EPE'09. 13th European Conference on. IEEE, 2009. http://ieeexplore.ieee.org/xpl/login.jsp?tp=&arnumber=5278945.

"Increasing control over energy and running costs," World Pumps, vol. 2015, Issue 5, May 2015, pp. 38-41._ http://www.sciencedirect.com/science/article/pii/S0262176215301061.

"Variable Speed Drive in Fan System Monitoring," Lappeenranta University of Technology, doria.fi, Acta Universitatis, Dec. 2013. https://www.doria.fi/bitstream/handle/10024/93928/isbn9789522655332.pdf?sequence=2.

"Energy-efficient control strategy for variable speed-driven parallel pumping systems." Energy Efficiency 6.3 (2013): 495-509. https://www.researchgate.net/publication/257768330_Energy-efficient_control_strategy_for_variable_speed-driven_parallel_pumping_systems.

"Accuracy Analysis of Frequency Converter Estimates in Diagnostic Applications." (2013) http://www.doria.fi/bitstream/handle/10024/88695/Thesis_CAAM_final_Doria.pdf?sequence=1.

"Design Envelope Parallel Sensorless Pump Controller," Armstrong Fluid Technology, armstrongfluidtechnology.com, 2014. http://www.armstrongfluidtechnology.com/en/products/design-envelope-parallel-sensorless-pump-controller.

"Estimation of the Efficiency for Variable Speed Pumps in EPANET Compared with Experimental Data." Procedia Engineering 89 (2014): 1404:1411. http:/www.sciencedirect.com/science/article/pii/S1877705814025818.

Fuel Filter/Water Separator Pump Systems: Smart Pumps for Precise Fuel Management, Racor, Parker, parker.com, Accessed: Jun. 2015. http://www.parker.com/literature/Racor/Racor_Fuel_Filtration-_Pump_System_Prodcuts_-_7683.pdf.

"Pump Smart Control Solutions," Brochure, ITT, hayespump.com 2008. http://www.hayespump.com/images/PSmartbulletin.pdf.

"Xylem Previews Integrated VFD with Sensorless Control on its Bell & Gossett Series 80 & 80-SC Pumps," Xylem—Let's Solve Water, unitedstates.xylemappliedwater.com, Accessed: Jun. 2015. http://unitedstates.xylemappliedwater.com/2013/01/28/xylem-previews-integrated-vfd-with-sensorless-control-on-its-bell-gossett-series-80-80-sc-pumps/.

* cited by examiner

FIG. 1C: For agricultural applications

FIG. 1: Examples of sensorless multistage pumping control systems

Figure 2A. Pump sensorless converter for pump pressure and flow rate from motor power and speed.

Apparatus 10

Signal processor or processing module 10a configured at least to:

receive signaling containing information about pump differential pressure, flow rate and corresponding power data at motor maximum speed published by pump manufacturers, as well as instant motor power and speed;

determine corresponding signaling containing information about instant pump differential pressure and flow rate using a combined affinity equation and numerical interpolation algorithm, based upon the signaling received; and/or provide the corresponding signaling as control signaling to control the apparatus.

Other signal processor circuits or components 10b that do not form part of the underlying invention, e.g., including input/output modules, one or more memory modules, data, address and control busing architecture, etc.

Figure 2B

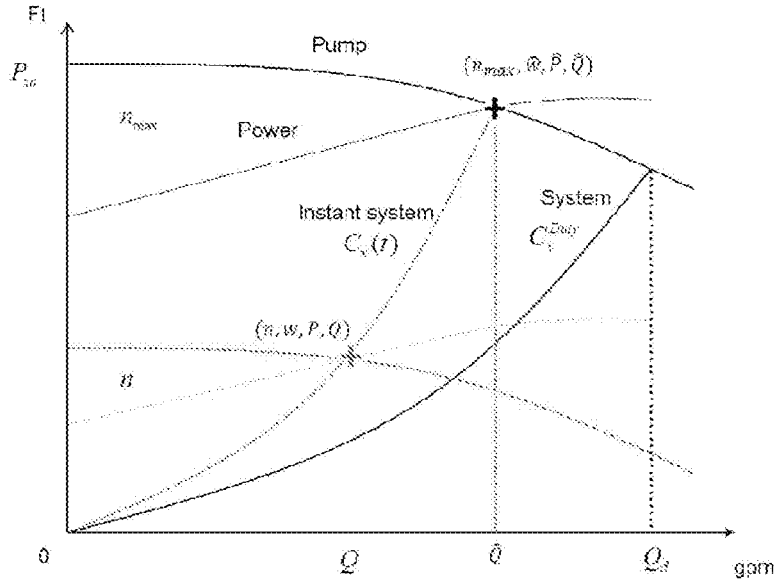
Figure 3. Pump, system and power characteristics curves with the pressure equilibrium point at a flow steady state.
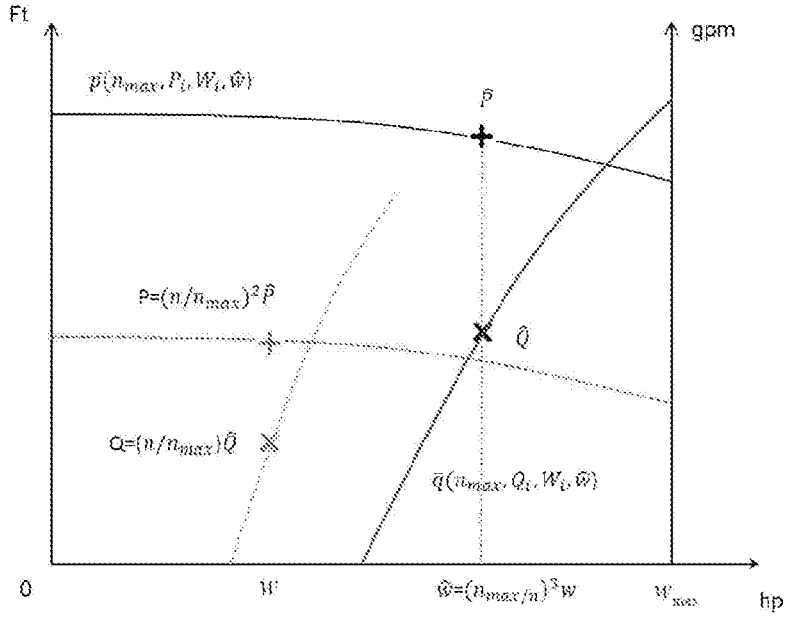
Figure 4. Pump sensorless pressure and flow rate conversion by affinity law and numerical means.

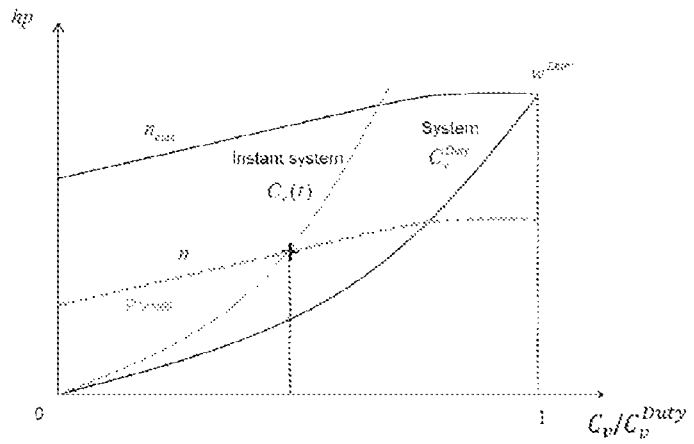
Figure 5: Motor power vs. normalized system characteristics.
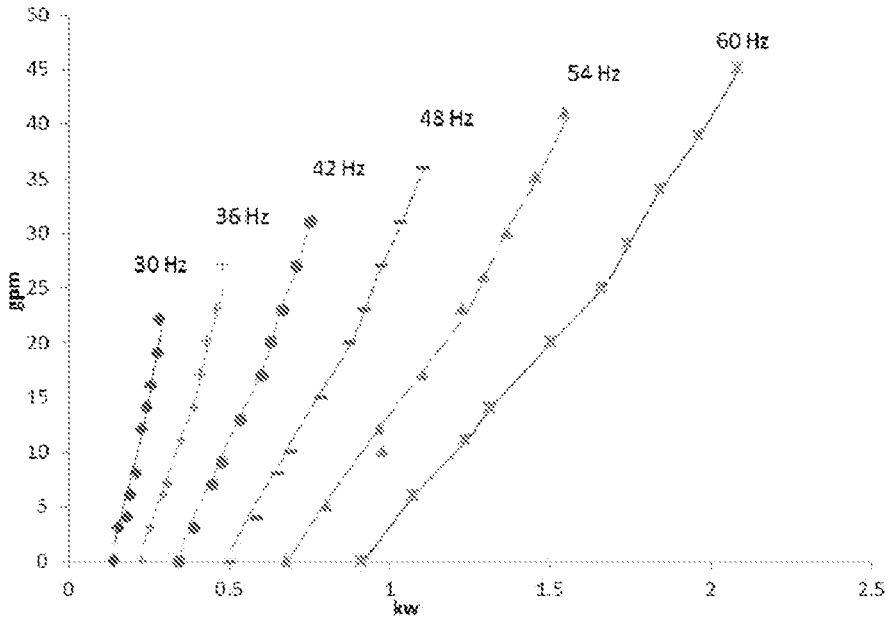
Fig. 6A: Flow rate (gpm) vs. power (kw)

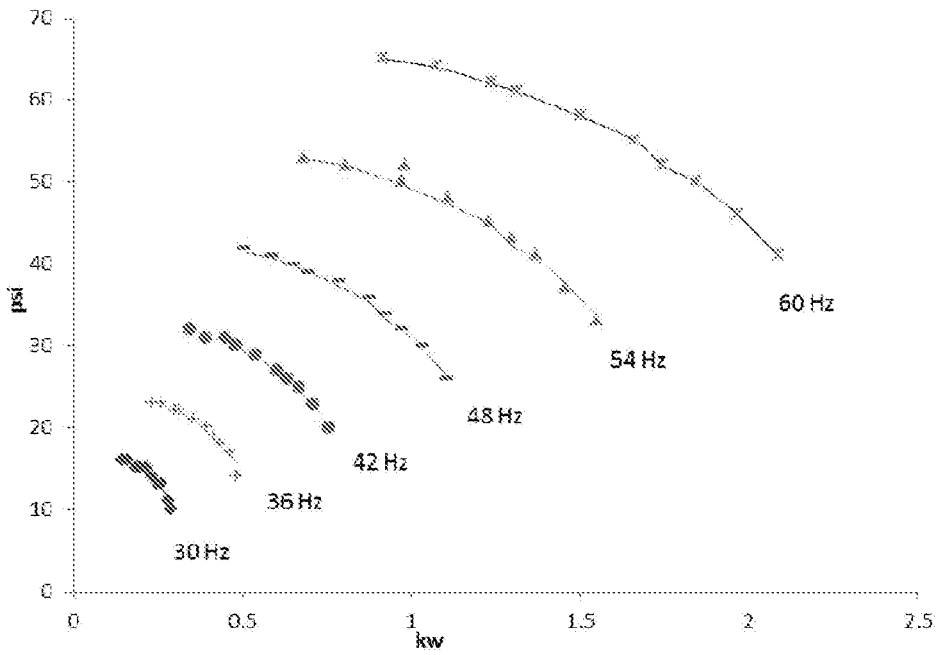
Fig. 6B: Pressure (psi) vs. power (kw)

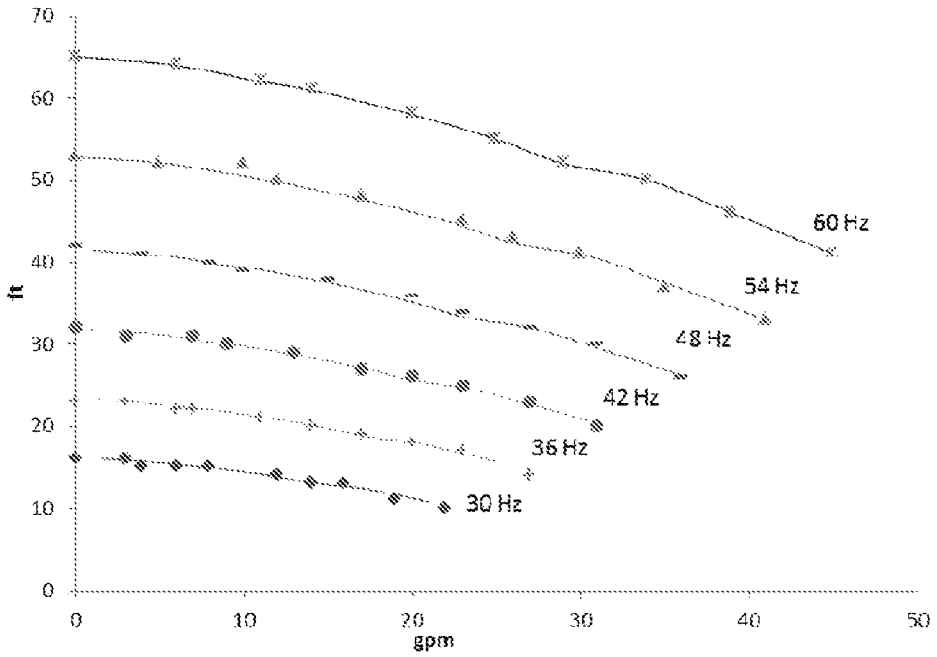

Fig. 6C: Pressure (ft) vs. flow rate (gpm)

Figure 6: Comparisons of pump differential pressure and system flow rate from the sensorless converter (e.g., see the six (6) respective solid lines for 30 Hz, 36 Hz, 42 Hz, 48 HZ, 54 Hz, 60 Hz) and the measured data from sensors (symbols, e.g., including: 30 Hz, diamond symbols; 36 Hz, plus ("+") signs; 42 Hz, solid circle symbols; 48 Hz, minus ("-") signs, 54 Hz, triangle symbols; and 60 Hz, "x" symbols).

DIRECT NUMERIC AFFINITY PUMPS SENSORLESS CONVERTER

CROSS REFERENCE TO RELATED APPLICATION

This application claims benefit to U.S. provisional application No. 62/170,997, filed 4 Jun. 2015, entitled "Direct numeric affinity pumps sensorless converter," which is hereby incorporated by reference in its entirety.

The present invention builds on the family of technologies disclosed in the other related applications identified below.

BACKGROUND OF THE INVENTION

1. Field of the Invention

The present invention relates to a technique for controlling pumping applications; and more particularly, the present invention relates to a method and apparatus for determining instant pump differential pressure and flow rate, and for controlling the pumping applications based upon the determination.

2. Brief Description of Related Art

In previous works by one or more of the inventors of the instant patent application, for hydronic pumping system sensorless control and monitoring, several discrete or numerical sensorless conversion techniques or means were developed and form part of a family of related works set forth in patent documents set forth below, e.g., including that set forth and referenced as documents [3] through [6] below.

For example, following a so-called 3D numerical conversion in the patent document referenced as [3] below, based upon using 3 distribution matrices of pump pressure, flow rate and power with respect to motor speed and system characteristics coefficients, the system pressure and flow rate were converted from a pair of motor readout values directly. The conversion accuracy was reasonably satisfactory, e.g., with around 5% error in the pump normal operation hydronic region.

However, in order to avoid tedious calibration data acquisition when using the 3D conversion method in pumping sensorless control application in field, a mixed discrete and theoretical conversion technique or means was developed and is set forth as well in the patent document referenced as [4] below, e.g., based upon using pump curve and system equations, yielding around 5-8% of the conversion error without the need for instrumentation calibration.

Further, a best-fit affinity sensorless conversion technique was also developed as set forth in patent document referenced as [6] below, e.g., based upon using pump and system characteristics equations together with the empirical power equation. The pump characteristics equation and the empirical power equation are reconstructed by using a polynomial best-fit approach from pump data published by pump manufacturers. System pressures and flow rate were resolved at the steady state equilibrium point of pump and system pressures by using those system and power characteristics equations accordingly, with around a 5% conversion error. However, for slightly more complicated pump pressure and power characteristic distribution curves, it was determined that this technique may pose a slight challenge in order to provide a better representation of the curves and to inverse or resolve those curve equations. The conversion accuracy may not always be satisfactory as well, e.g. for slightly more complicated pump characteristics distributions.

In view of the aforementioned, there remains a need in the pump industry for a better way to determine pump pressure differential and flow rate for sensorless pumping control applications without the need to reconstruct and solve any pump and system characteristics equations.

SUMMARY OF THE INVENTION

In summary, according to the present invention, a new and unique direct numeric affinity pump sensorless converter is provided herein, e.g., based upon using the pump differential pressure, flow rate and power at pump maximum speed without a need to reconstruct and solve any pump and system characteristics equations. The sensorless converter signal processing technique, or means for implementing the same, provided herein may be applied to any form of pump characteristics distribution, simple or complicated, as long as the monotonic power distribution with respect to flow is preserved. The computation accuracy is significantly improved as well, since there is no need to have the system characteristics coefficient to be inversed from the power to solve pump and system equations, and there is also no extra effort for having the calibrating data as well.

Specific Embodiments

By way of example, the present invention provides a new and unique technique for a sensorless pumping control application.

According to some embodiments, the present invention may include, or take the form of, a method or apparatus, e.g., in a hydronic pumping control applications or systems, featuring a signal processor or signal processing module, configured to:

- receive signaling containing information about pump differential pressure, flow rate and corresponding power data at motor maximum speed published by pump manufacturers, as well as instant motor power and speed; and
- determine corresponding signaling containing information about instant pump differential pressure and flow rate using a combined affinity equation and numerical interpolation algorithm, based upon the signaling received.

According to some embodiments, the present invention may include one or more of the following features:

The signal processor or processing module may be configured to provide the corresponding signaling as control signaling to control a pump in a pumping system, e.g., including a hydronic pumping system.

The signal processor or processing module may be configured to determine the corresponding signaling, e.g., by implementing the combined affinity equation and numerical interpolation algorithm as follows:

- obtaining a corresponding maximum power at the pump's maximum speed with respect to the instant motor power and speed parameters using a power affinity equation;
- obtaining corresponding pump differential pressure and flow rate with respect to the corresponding maximum power at the pump's maximum speed using direct numerical interpolation; and
- determining the instant pump differential pressure and flow rate with respect to the instant motor speed and power by using pressure and flow affinity equations.

The signal processor or processing module may be configured to determine the instant pump differential pressure and flow rate by implementing the combined affinity equation and numerical interpolation algorithm and using numerical computation procedures as follows:

$$Q(n, w) = \left(\frac{n}{n_{max}}\right) \cdot \bar{q}(n_{max}, W_i, Q_i, \hat{w}(n, w)), \quad (1)$$

$$P(n, w) = \left(\frac{n}{n_{max}}\right)^2 \cdot \bar{p}(n_{max}, W_i, P_i, \hat{w}(n, w)), \quad (2)$$

where $\bar{q}(n_{max}, W_i, Q_i, \hat{w})$ and $\bar{p}(n_{max}, W_i, P_i, \hat{w})$ are pump differential pressure and flow rate distribution functions with respect to power and formulated numerically based upon discrete pump data of ($P_i$, $Q_i$, $W_i$) at motor full speed, and $\hat{w}$ is a corresponding power function at pump full speed by the power affinity equation of $$\hat{w}(n,w)=(n/n_{max})^{-3} \cdot w. \quad (3)$$

The apparatus may include, or take the form of, a pump controller for controlling a pump, e.g., in such a hydronic pumping system.

The apparatus may include, or take the form of, a hydronic pumping system having a pump and a pump controller, including where the pump controller is configured with the signal processor or processing module for controlling the pump By way of example, the signal processor or processing module may include, or take the form of, at least one signal processor and at least one memory including computer program code, and the at least one memory and computer program code are configured to, with at least one signal processor, to cause the signal processor at least to receive the signaling (or, for example, the associated signaling) and determine the corresponding signaling, based upon the signaling received. The signal processor or processing module may be configured with suitable computer program code in order to implement suitable signal processing algorithms and/or functionality, consistent with that set forth herein.

According to some embodiments, the present invention may also take the form of a method including steps for:

- receiving in a signal processor or processing module signaling containing information about pump differential pressure, flow rate and corresponding power data at motor maximum speed published by pump manufacturers, as well as instant motor power and speed; and
- determining in the signal processor or processing module corresponding signaling containing information about instant pump differential pressure and flow rate using a combined affinity equation and numerical interpolation algorithm, based upon the signaling received.

The method may also include one or more of the features set forth herein, including providing from the signal processor or processing module corresponding signaling as control signaling to control a pump in a pumping system, e.g., including a hydronic pumping system.

The instant application provides a new technique that is a further development of, and builds upon, the aforementioned family of technologies set forth herein.

BRIEF DESCRIPTION OF THE DRAWING

The drawing includes the following Figures, which are not necessarily drawn to scale:

FIGS. 1A, 1B and 1C show examples of sensorless multistage pumping control systems, e.g., in which the present invention may be implemented, or form part of, according to some embodiments of the present invention.

FIG. 2A is a schematic diagram of a pump sensorless converter for providing pump pressure (ft) and flow rate (GPM) from motor power (hp) and speed (RPM), e.g., in which the present invention may be implemented, or form part of, according to some embodiments of the present invention.

FIG. 2B is a block diagram of apparatus, e.g., having a signal processor or processing module, configured for implementing the signal processing functionality, according to some embodiments of the present invention.

FIG. 3 shows a graph of pump pressure (Ft) vs. flow rate (gpm) showing pump, system and power characteristic curves with a pressure equilibrium point at a flow steady state.

FIG. 4 shows a graph of pump pressure (Ft), motor power (hp) and flow rate (gpm) showing a pump sensorless pressure and flow rate conversion by using a affinity and numerical signal processing technique, e.g., according to implementations of some embodiments of the present invention.

FIG. 5 shows a graph of motor power (hp) vs. normalized system characteristics ($Cv/Cv^{Duty}$), e.g. according to implementations of some embodiments of the present invention.

FIGS. 6A, 6B and 6C show comparisons of pump differential pressure and system flow rate from the sensorless converter, e.g., each having six (6) respective solid lines for 30 Hz, 36 Hz, 42 Hz, 48 HZ, 54 Hz, 60 Hz, and each also having measured data from sensors indicated by symbols, e.g., including: for 30 Hz, diamond symbols; 36 Hz, plus ("+") signs; 42 Hz, solid circle symbols; 48 Hz, minus ("−") signs, 54 Hz, triangle symbols; and 60 Hz, "x" symbols; where FIG. 6A shows a graph of flow rate (gpm) vs. power (kw); FIG. 6B shows a graph of pressure (psi) vs. power (kw); and FIG. 6C shows a graph of pressure (ft) vs. flow rate (gpm).

DETAILED DESCRIPTION OF THE INVENTION

FIGS. 2A and 2B: Implementation of Signal Processing Functionality

In summary, the present invention provides a new and unique direct numerical affinity pump sensorless conversion signal processing technique, or means for implementing the same, e.g. based upon processing the pump differential pressure, flow rate and power at pump maximum speed published by pump manufacturers, as well as the pump affinity law in order to obtain instant pump differential pressures and flow rate directly and numerically. The sensorless converter signal processing technique, or means for implementing the same, set forth herein may be applied to any form of pump characteristics distributions simple or complicated, since there is no need to reconstruct and to solve any pump and system characteristics equations. As a result, the computation accuracy is significantly improved.

Figure 1B:
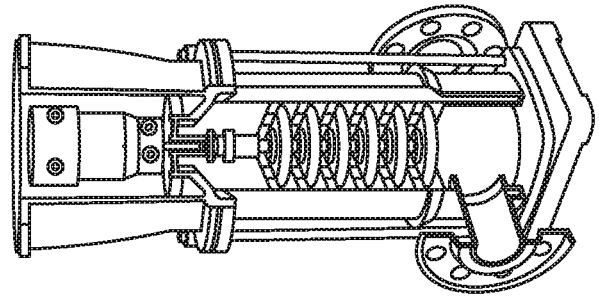
Figure 1A:
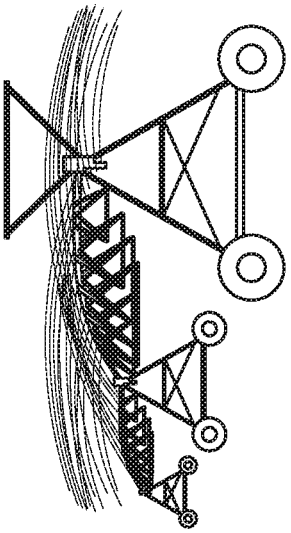
Figure 1A:
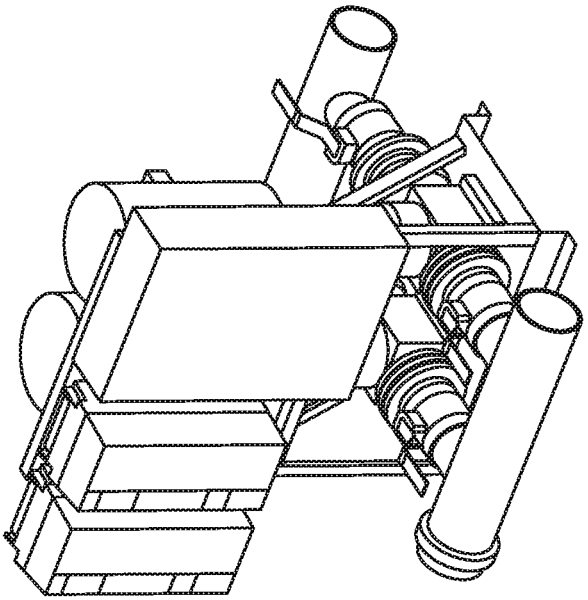

FIGS. 1A, 1B and 1C show examples of sensorless multistage pumping control systems, e.g., in which the present invention may be implement, or form part of, according to some embodiments of the present invention. For example, FIG. 1A shows a hydronic pumping and variable speed control system, while FIGS. 1B and 1C show a pump sensorless converter for pump differential pressure and flow rate associated with the hydronic system coefficient at the discharge of a pump and the motor power and speed at the other end of a motor drive.

By way of example, the direct numerical affinity pump sensorless conversion signal processing technique, or means for implementing the same, may include, or form part of, a pump sensorless converter shown in FIG. 2A, which processes signaling containing information about motor power (hp) and speed (RPM) and determines suitable processed signaling containing information about pump pressure (ft) and flow rate (GPM). The pump sensorless converter shown in FIG. 2A may be implemented, or form part of apparatus, e.g., consistent with that set forth herein.

By way of further example, FIG. 2B shows apparatus 10 according to some embodiments of the present invention, e.g., featuring a signal processor or processing module 10*a* configured at least to:

receive signaling containing information about pump differential pressure, flow rate and corresponding power data at motor maximum speed published by pump manufacturers, as well as instant motor power and speed; and determine corresponding signaling containing information about instant pump differential pressure and flow rate using a combined affinity equation and numerical interpolation algorithm, based upon the signaling received.

In operation, the signal processor or processing module may be configured to provide corresponding signaling as control signaling to control a pump in a pumping system, e.g., such as a hydronic pumping system. The corresponding signaling may contain information used to control the pumping hydronic system.

The signal processor or processing module 10*a* may be configured in, or form part of, a pump and/or a pump control, e.g., which may include or be implemented in conjunction with a pump control or controller configured therein. By way of example, embodiments are envisioned in which the apparatus is a pump having the signal processor or processing module 10*a*, and embodiments are envisioned in which the apparatus is a pump control or controller having the signal processor or processing module 10*a*.

As one skilled in the art would appreciate and understand, the present invention may be implemented using system characteristics and associated equations, e.g., consistent with that set forth herein, as well as by using other types or kinds of system characteristics and associated equations that are either now known or later developed in the future.

By way of example, the functionality of the apparatus 10 may be implemented using hardware, software, firmware, or a combination thereof. In a typical software implementation, the apparatus 10 would include one or more microprocessor-based architectures having, e. g., at least one signal processor or microprocessor like element 10*a*. One skilled in the art would be able to program with suitable program code such a microcontroller-based, or microprocessor-based, implementation to perform the functionality described herein without undue experimentation. For example, the signal processor or processing module 10*a* may be configured, e.g., by one skilled in the art without undue experimentation, to receive the signaling containing information about pump differential pressure, flow rate and corresponding power data at motor maximum speed published by pump manufacturers, as well as instant motor power and speed, consistent with that disclosed herein.

Moreover, the signal processor or processing module 10*a* may be configured, e.g., by one skilled in the art without undue experimentation, to determine the corresponding signaling containing information about instant pump differential pressure and flow rate using a combined affinity equation and numerical interpolation algorithm, consistent with that disclosed herein.

The scope of the invention is not intended to be limited to any particular implementation using technology either now known or later developed in the future. The scope of the invention is intended to include implementing the functionality of the processors 10*a* as stand-alone processor, signal processor, or signal processor module, as well as separate processor or processor modules, as well as some combination thereof.

The apparatus 10 may also include, e.g., other signal processor circuits or components 10*b*, including random access memory or memory module (RAM) and/or read only memory (ROM), input/output devices and control, and data and address buses connecting the same, and/or at least one input processor and at least one output processor, e.g., which would be appreciate by one skilled in the art.

FIGS. 3-6C: Detailed Implementation

The following is a detailed description of an implementation of the present invention, e.g., consistent with that set forth in relation to FIGS. 3 to 6C.

Considering a close loop system, pump flow rate and differential pressure at a motor speed for a system position given may be resolved at a steady equilibrium state of pump and system pressures, e.g., which is the intersection of the pump and system curves functions shown schematically in FIG. 3. Here, the instant pump characteristic curve, or pump curve, represents the pump differential pressure P with respect to flow rate Q at a motor speed of n. The instant system curve represents the system flow equation of $C_v=Q/\sqrt{P}$ accordingly. The pump affinity law, represented by the equations for pump flow, differential pressure and motor power (w), i.e., $Q/Q_{max}=n/n_{max}$, $P/P_{max}=(n/n_{max})^2$ and $w/w_{max}=(n/n_{max})^3$, may be used to compute and determine the pump differential pressure, flow rate and power with respect to an instant motor speed of n at a system position, respectively. Instead of resolving the pump and system curves equations to obtain the steady equilibrium state solution of pressure and flow at any pump speed in the patent document referenced as [6] below, a direct numerical affinity sensorless conversion approach is set forth herein, e.g., consistent with that shown schematically in FIG. 4. Here, the pump differential pressure, flow rate and their corresponding power data at motor maximum speed, together with the pump affinity law, may be used to resolve the instant pressure and flow rate of P and Q with respect to instant motor speed and power of n and w directly and numerically.

The numerical determination, computational and signal processing procedures to obtain instant pump differential pressure and flow rate of P and Q are as following. First, the corresponding maximum power of $\hat{w}$ at pump maximum speed of $n_{max}$ with respect to a pair of instant motor power and speed of n and W may be obtained by using the power affinity equation. The corresponding pump differential pressure and flow rate of $\hat{P}$ and $\hat{Q}$ with respect to the power of $\hat{w}$ at $n_{max}$ can then be obtained by using numerical interpolation directly. Finally, the instant pressure and flow rate of P and Q with respect to instant motor speed and power of n and w may be achieved by the pressure and flow affinity equations based upon the pump differential pressure and flow rate of $\hat{P}$ and $\hat{Q}$, respectively. Note that the affinity law implies that the sensorless parameter conversion is along the system characteristics curve shown in FIG. 3.

The pump differential pressure and flow rate by following the numerical determination, computation and signal processing procedures described above may be written in form of equations (1) and (2), as follows:

$$Q(n, w) = \left(\frac{n}{n_{max}}\right) \cdot \overline{q}(n_{max}, W_i, Q_i, \hat{w}(n, w)), \text{ and} \quad (1)$$

$$P(n, w) = \left(\frac{n}{n_{max}}\right)^2 \cdot \overline{p}(n_{max}, W_i, P_i, \hat{w}(n, w)), \quad (2)$$

where $\overline{q}(n_{max}, W_i, Q_i, \hat{w})$ and $\overline{p}(n_{max}, W_i, P_i, \hat{w})$ are the pump differential pressure and flow rate distribution functions with respect to power and formulated numerically based upon the discrete pump data of $(P_i, Q_i, W_i)$ at motor full speed of $n_{max}$ (or at any speed given), and $\hat{w}$ is the corresponding power function at pump full speed of $n_{max}$ by the power affinity equation (3) of:

$$\hat{w}(n,w)=(n/n_{max})^{-3}\cdot w. \quad (3)$$

The distribution functions of $\overline{q}$ and $\overline{p}$ may be formulated directly through the numerical signal processing technique or means, for instance, by implementing interpolation or curve fitting, based upon their discrete pump testing data of $(P_i, Q_i, w_i)$ at motor full speed of $n_{max}$. However, for slightly more complicated distributions, a piecewise numeric interpolation may be implemented to achieve a better functional representation and desired accuracy. Note that the monotonic distribution on power with respect to flow may be required here as well.

In case, e.g., if there may be the accuracy requirement at low speed region with system nearly shut down, the pump power affinity law of Eq. 3 may not be sufficient to represent the relation of motor power and speed well due to motor speed slip in low speed as indicated in the patent document referenced as [6] below. A modified form of the power affinity law representation may, therefore, be formulated similarly using the equation (4) as follows:

$$\hat{w}(n,w)=\overline{w}_{norm}(n_i,W_i,n)\cdot w. \quad (4)$$

where $\overline{w}_{norm}(n_i, W_i, n)$ is the power distribution function calibrated based upon an array of the discrete and normalized motor power data of $(n_i, W_i)$ at any system position, which may be obtained numerically by interpolation or fitting as well. Note that the system position can be any position from shut off to fully open, since the normalized power distribution of $\overline{w}_{norm}$ with respect to speed of n is nearly identical at any system position.

For a varying hydronic system with flow regulated by valves or other flow regulators, one may also want to know the instant system characteristic coefficient for a system position at an instant time. By following the similar approach, the normalized system characteristics coefficient with respect to the power data at motor full speed $n_{max}$, presented in FIG. 5, may be formulated directly as that set forth in equation (5):

$$C_v^{norm}(w,n)=\overline{C}_v^{norm}(n_{max},W_i,\overline{C}_{vi}^{norm},\hat{w}(n,w)). \quad (5)$$

where $\overline{C}_v^{norm}(n_{max}, W_i, \overline{C}_{vi}^{norm}, \hat{w}(n,w))$ is the system coefficient distribution function with respect to the normalized motor power data and instant reversed maximum power of $\hat{w}(n,w)$ at pump maximum speed. Note that the instant system coefficient is the same value along the instant system characteristics curve, shown in FIG. 3.

By using the direct numeric affinity sensorless converter defined in Equations 1-4, the pressure and flow rate values may be determined and computed for a pumping system and compared with the measured data, which are shown in FIGS. 6A-6C, respectively. The conversion accuracy is reasonably satisfactory with around 5% error in the pump normal operation hydronic region.

The direct numerical affinity pump sensorless converter set forth herein may be used for most hydronic pumping control and monitoring applications, since it is formulated directly and numerically from pump, power characteristics data published by pump manufacturers testing data as well as affinity law, without the need of resolving any characteristic equations reversely as set forth in the patent documents referenced as [3] through [6] below. The technique may be applied to any form of pump characteristics distribution pump simple or complicated, as long as the monotonic power distribution with respect to flow is preserved. Moreover, the direct numerical pump sensorless converter developed herein is much easier to be set up while providing reasonably satisfactory accuracy.

Various Points of Novelty

The present invention may also include, or take the form of, one or more of the following embodiments/implementations:

According to some embodiments, the present invention may include, or take the form of, implementations where the direct numeric affinity pump sensorless converter includes a pump sensorless converter which yields the pump differential pressure and system flow rate with respect to a given pair of motor speed and power readouts, based on the pump differential pressure, flow rate and power at pump maximum speed published by pump manufacturers as well as the pump affinity law. The direct numerical computation procedures to obtain the instant pump differential pressures and flow rate directly and numerically are presented schematically in FIGS. 3 and 4 as well. The signal processing technique, or means for implementing the same, may be applied to any form of pump characteristics distributions, as long as the monotonic power distribution with respect to flow is preserved.

According to some embodiments, the present invention may include, or take the form of, implementations where the direct numeric affinity pump sensorless converter mentioned above includes the numerical expression of pump differential pressure and flow rate of P(n,w) and Q(n,w) of Equations 1 and 2, at the steady state equilibrium point of the pump differential pressure and system pressure, which is the intersection of the pump and system curves schematically, based upon the pump differential pressure and flow rate numerical distribution data of $(P_i, Q_i, W_i)$ at motor full speed and the pump affinity law.

According to some embodiments, the present invention may include, or take the form of, implementations where the direct numeric distribution functions in the direct numeric affinity pump sensorless converter mentioned above includes the signal processing technique, or means for implementing the same, to formulate the pump pressure and flow rate distribution function in terms of power at maximum speed directly and numerically, as shown in FIG. 4. For that, there is no need to have the system characteristics coefficient to be inversed from the power, prior to obtaining pump pressure and flow rate. The computation accuracy is significantly improved.

According to some embodiments, the present invention may include, or take the form of, implementations where the direct numeric procedures in the direct numeric affinity pump sensorless converter mentioned above includes:

1) the corresponding maximum power of $\hat{w}$ at pump maximum speed of $n_{max}$ with respect to a pair of instant motor power and speed of n and w is obtained by using power affinity equation;
2) the corresponding pump differential pressure and flow rate of $\hat{P}$ and $\hat{Q}$ with respect to the power of $\hat{w}$ at $n_{max}$ are obtained by using numerical interpolation directly;
3) the instant pressure and flow rate of P and Q with respect to instant motor speed and power of n and w are achieved finally by the pressure and flow affinity equations based upon the pump differential pressure and flow rate of $\hat{P}$ and $\hat{Q}$, respectively.

Note that the affinity law implies that the sensorless parameter conversion is along the system characteristics curve shown in FIG. 3.

According to some embodiments, the present invention may include, or take the form of, implementations where the steady state pressure equilibrium point in the direct numeric affinity pump sensorless converter mentioned above includes the intersection point of the pump and system curves functions, as shown in FIG. 3. The system pressure or pump differential pressure and flow rate may be resolved by Equations 1 and 2, at the pressures equilibrium point for a pair of motor readout values given.

According to some embodiments, the present invention may include, or take the form of, implementations where the numeric methods in the direct numeric affinity pump sensorless converter mentioned above may include any kinds of numerical interpolation and fitting algorithms to obtain the pump differential pressure and flow rate of $\hat{P}$ and $\hat{Q}$ at pump maximum speed. However, it is note that, for slightly complicated distributions, the piecewise numeric interpolation may be recommended to achieve better functional representation and accuracy.

According to some embodiments, the present invention may include, or take the form of, implementations using use the pump power affinity function in Equation 3, e.g., in order to obtain the power of $\hat{w}$ at maximum pump speed in the direct numeric affinity pump sensorless converter mentioned above. A preferred version of the modified power affinity function may be formulated similarly with a numerical distribution expression of $\overline{w}_{norm}(n_i, W_i, n)$ in Equation 4, e.g., calibrated based upon an array of the discrete and normalized motor power data of $(n_i, W_i)$ at any system position, which may again be obtained numerically by interpolation or fitting. The modified power affinity function calibrated may be introduced to compensate the power loss due to motor speed slip at low speed region.

According to some embodiments, the present invention may include, or take the form of, implementations where the system characteristics coefficient numeric conversion in the direct numeric affinity pump sensorless converter includes the system characteristics coefficient numeric function in form of $\overline{C}_v^{norm}(n_{max}, W_i, \overline{C}_{vi}^{norm}, \hat{w}(n,w))$ in Equation 5, which is the system coefficient distribution with respect to the normalized motor power. For an instant reversed maximum power of $\hat{w}(n,w)$ at pump maximum speed obtained from Equations 3 or 4, the instant system coefficient of may be obtained by Equation 5 directly and numerically by interpolation or fitting. Note that the instant system coefficient may be the same value along the instant system characteristics curve shown in FIG. 3.

According to some embodiments, the present invention may include, or take the form of, implementations where the pump and power curves data at motor maximum speed in the direct numeric affinity pump sensorless converter for converting pump differential pressure and flow from pump power and speed includes the pump and power curves data published by pump manufacturers or a few points of pump data acquired at motor full speed in field. Here, the motor power curve data may also be replaced by any potential motor electrical or mechanical readout signals, such as motor current or torque, and so forth.

According to some embodiments, the present invention may include, or take the form of, implementations where the pumping hydronic system in the direct numeric affinity pump sensorless converter includes all close loop or open loop hydronic pumping systems, such as primary pumping systems, secondary pumping systems, water circulating systems, and pressure booster systems. The systems mentioned here may consist of a single zone or multiple zones as well.

According to some embodiments, the present invention may include, or take the form of, implementations where the hydronic signals for in the direct numeric affinity pump sensorless converter may include pump differential pressure, system pressure or zone pressure, system or zone flow rate, and so forth.

According to some embodiments, the present invention may include, or take the form of, implementations where control signals transmitting and wiring technologies may include all conventional sensing and transmitting techniques or means that are used currently and known in the art. Preferably, wireless sensor signal transmission technologies would be optimal and favorable.

According to some embodiments, the present invention may include, or take the form of, implementations where the pumps mentioned above for the hydronic pumping systems may include a single pump, a circulator, a group of parallel ganged pumps or circulators, a group of serial ganged pumps or circulators, or their combinations.

According to some embodiments, the present invention may include, or take the form of, implementations where systems flow regulation may include manual or automatic control valves, manual or automatic control circulators, or their combinations.

Hydronic Characteristics and Discrete Distribution Functions

Techniques for determining a hydronic characteristics, and techniques for plotting distributions of such hydronic characteristics, e.g., like that shown in FIGS. 3-6, are also known in the art; and the scope of the invention is not intended to be limited to any particular type or kind thereof that is either now known or later developed in the future.

Moreover, one person skilled in the art would be able to implement the underlying invention without undue experimentation based upon that disclosed herein, including determining hydronic characteristics, and plotting distributions of such hydronic characteristics like that shown herein.

Computer Program Product

The present invention may also, e. g., take the form of a computer program product having a computer readable medium with a computer executable code embedded therein for implementing the method, e.g., when run on a signal processing device that forms part of such a pump or valve controller. By way of example, the computer program product may, e. g., take the form of a CD, a floppy disk, a memory stick, a memory card, as well as other types or kind of memory devices that may store such a computer executable code on such a computer readable medium either now known or later developed in the future.

OTHER RELATED APPLICATIONS

The application is related to other patent applications that form part of the overall family of technologies developed by one or more of the inventors herein, and disclosed in the following applications:

[1] U.S. application Ser. No. 12/982,286, filed 30 Dec. 2010, entitled "Method and apparatus for pump control using varying equivalent system characteristic curve, AKA an adaptive control curve," which issued as U.S. Pat. No. 8,700,221 on 15 Apr. 2014; and

[2] U.S. application Ser. No. 13/717,086, filed 17 Dec. 2012, entitled "Dynamic linear control methods and apparatus for variable speed pump control," which claims benefit to U.S. provisional application No. 61/576,737, filed 16 Dec. 2011, now abandoned;

[3] U.S. application Ser. No. 14/091,795, filed 27 Nov. 2013, entitled "3D sensorless conversion method and apparatus," which claims benefit to U.S. provisional application No. 61/771,375, filed 1 Mar. 2013, now abandoned;

[4] U.S. application Ser. No. 14/187,817, filed 24 Feb. 2014, entitled "A Mixed Theoretical And Discrete Sensorless Converter For Pump Differential Pressure And Flow Monitoring," which claims benefit to U.S. provisional application No. 61/803,258, filed 19 Mar. 2013, now abandoned;

[5] U.S. application Ser. No. 14/339,594, filed 24 Jul. 2014, entitled "Sensorless Adaptive Pump Control with Self-Calibration Apparatus for Hydronic Pumping System," which claims benefit to U.S. provisional application Ser. No. 14/339,594, filed 24 Jul. 2014, now abandoned;

[6] U.S. application Ser. No. 14/680,667, filed 7 Apr. 2015, entitled "A Best-fit affinity sensorless conversion means for pump differential pressure and flow monitoring," which claims benefit to provisional patent application Ser. No. 61/976,749, filed 8 Apr. 2014, now abandoned; and

[7] U.S. application Ser. No. 14/730,871, filed 4 Jun. 2015, entitled "System and flow adaptive sensorless pumping control apparatus energy saving pumping applications," which claims benefit to provisional patent application Ser. No. 62/007,474, filed 4 Jun. 2014, now abandoned; and

[8] U.S. application Ser. No. 14/969,723, filed 15 Dec. 2015, entitled "Discrete valves flow rate converter," which claims benefit to U.S. provisional application No. 62/091,965, filed 15 Dec. 2014;

[9] U.S. application Ser. No. 15/044,670, filed 16 Feb. 2016, entitled "Detection means for sensorless pumping control applications," which claims benefit to U.S. provisional application No. 62/116,031, filed 13 Feb. 2015, entitled "No flow detection means for sensorless pumping control applications;"

[10] U.S. provisional application No. 62/196,355, filed 24 Jul. 2015, entitled "Advanced real time graphic sensorless energy saving pump control system;"

[11] U.S. provisional application No. 62/341,767, filed 26 May 2016, entitled "Direct numeric affinity multistage pumps sensorless converter;"

[12] U.S. provisional application No. 62/343,352, filed 31 May 2016, entitled "Pump control design toolbox means for variable speed pumping application;"

which are all assigned to the assignee of the instant patent application, and which are all incorporated by reference in their entirety.

THE SCOPE OF THE INVENTION

It should be understood that, unless stated otherwise herein, any of the features, characteristics, alternatives or modifications described regarding a particular embodiment herein may also be applied, used, or incorporated with any other embodiment described herein. Also, the drawing herein is not drawn to scale.

Although the present invention is described by way of example in relation to a centrifugal pump, the scope of the invention is intended to include using the same in relation to other types or kinds of pumps either now known or later developed in the future.

Although the invention has been described and illustrated with respect to exemplary embodiments thereof, the foregoing and various other additions and omissions may be made therein and thereto without departing from the spirit and scope of the present invention.

What we claim is:

1. A pumping system comprising:

a pump driven by a motor; and a pump controller having a signal processor or processing module configured at least to:

receive signaling containing information about pump data published by a manufacturer of the pump, the pump data including pump differential pressure, flow rate and corresponding power data all at motor maximum speed, as well as instant motor power and speed; and determine corresponding signaling containing information about instant pump differential pressure and flow rate using a combined affinity equation and numerical interpolation algorithm to control the pump in the pumping system, based upon the signaling received.

2. A pumping system according to claim 1, wherein the signal processor or processing module is configured to provide the corresponding signaling as control signaling to control a hydronic pumping system.

3. A pumping system according to claim 2, wherein the hydronic pumping system comprises a close or open loop hydronic pumping system, including a primary pumping system, a secondary pumping system, a water circulating system, or a pressure booster system.

4. A pumping system according to claim 3, wherein the close or open loop hydronic pumping system comprises a single zone or multiple zones.

5. A pumping system according to claim 1, wherein the signal processor or processing module is configured to determine the corresponding signaling by implementing the combined affinity equation and numerical interpolation algorithm as follows:

obtaining a corresponding maximum power at the pump's maximum speed with respect to the instant motor power and speed parameters using a power affinity equation;

obtaining corresponding pump differential pressure and flow rate with respect to the corresponding maximum power at the pump's maximum speed using direct numerical interpolation; and determining the instant pump differential pressure and flow rate with respect to the instant motor speed and power by using pressure and flow affinity equations.

6. A pumping system according to claim 5, wherein the signal processor or processing module is configured to determine the instant pump differential pressure and flow rate by implementing the combined affinity equation and numerical interpolation algorithm and using numerical computation procedures as follows:

$$Q(n, w) = \left(\frac{n}{n_{max}}\right) \cdot \bar{q}(n_{max}, W_i, Q_i, \hat{w}(n, w)), \quad (1)$$

$$P(n, w) = \left(\frac{n}{n_{max}}\right)^2 \cdot \bar{p}(n_{max}, W_i, P_i, \hat{w}(n, w)), \quad (2)$$

where $\bar{q}(n_{max}, W_i, Q_i, w)$ and $\bar{p}(n_{max}, W_i, P_i, \hat{w})$ and are pump differential pressure and flow rate distribution functions with respect to power and formulated numerically based upon discrete pump data of $(P_i, Q_i, W_i)$ at motor full speed, and $\hat{w}$ is a corresponding power function at pump full speed by the power affinity equation of $$\hat{w}(n,w)=(n/n_{max})^{-3} \cdot w, \quad (3)$$

where of n is the motor speed and w is power.

7. A pumping system according to claim 1, wherein the pumping system comprises a hydronic pumping system having the pump and the pump controller for controlling the pump.

8. A pumping system according to claim 1, wherein the pump is a single pump, a circulator, a group of parallel ganged pumps or circulators, a group of serial ganged pumps or circulators, or some combination thereof.

9. A method for controlling a pump driven by a motor in a pumping system, comprising:

receiving in a pump controller having a signal processor or processing module signaling containing information about pump data published by a manufacturer of the pump, the pump data including pump differential pressure, flow rate and corresponding power data all at motor maximum speed, as well as instant motor power and speed; and determining in the signal processor or processing module corresponding signaling containing information about instant pump differential pressure and flow rate using a combined affinity equation and numerical interpolation algorithm to control the pump in the pumping system, based upon the signaling received.

10. A method according to claim 9, wherein the method comprises providing from the signal processor or processing module the corresponding signaling as control signaling to control a hydronic pumping system.

11. A method according to claim 10, wherein the method comprises configuring the hydronic pumping system as a close or open loop hydronic pumping system, including a primary pumping system, a secondary pumping system, a water circulating system, or a pressure booster system.

12. A method according to claim 11, wherein the method comprises configuring the close or open loop hydronic pumping system as a single zone or multiple zones.

13. A method according to claim 9, wherein the method comprises determining in the signal processor or processing module the corresponding signaling by implementing the combined affinity equation and numerical interpolation algorithm as follows:

obtaining a corresponding maximum power at the pump's maximum speed with respect to the instant motor power and speed parameters using a power affinity equation;

obtaining corresponding pump differential pressure and flow rate with respect to the corresponding maximum power at the pump's maximum speed using direct numerical interpolation; and determining the instant pump differential pressure and flow rate with respect to the instant motor speed and power by using pressure and flow affinity equations.

14. A method according to claim 13, wherein the method comprises determining in the signal processor or processing module the instant pump differential pressure and flow rate by implementing the combined affinity equation and numerical interpolation algorithm and using numerical computation procedures as follows:

$$Q(n, w) = \left(\frac{n}{n_{max}}\right) \cdot \bar{q}(n_{max}, W_i, Q_i, \hat{w}(n, w)), \quad (1)$$

$$P(n, w) = \left(\frac{n}{n_{max}}\right)^2 \cdot \bar{p}(n_{max}, W_i, P_i, \hat{w}(n, w)), \quad (2)$$

where $\bar{q}(n_{max}, W_i, Q_i, w)$ and $\bar{p}(n_{max}, W_i, P_i, \hat{w})$ and are pump differential pressure and flow rate distribution functions with respect to power and formulated numerically based upon discrete pump data of $(P_i, Q_i, W_i)$ at motor full speed, and $\hat{w}$ is a corresponding power function at pump full speed by the power affinity equation of $$\hat{w}(n,w)=(n/n_{max})^{-3} \cdot w, \quad (3)$$

where of n is the motor speed and w is power.

15. A method according to claim 9, wherein the method comprises configuring the pumping system as a hydronic pumping system having the pump and the pump controller for controlling the pump.

16. A method according to claim 9, wherein the method comprises configuring the pump as a single pump, a circulator, a group of parallel ganged pumps or circulators, a group of serial ganged pumps or circulators, or some combination thereof.

* * * * *